US005895345A

United States Patent [19]

Knelson

[11] Patent Number: 5,895,345

[45] Date of Patent: Apr. 20, 1999

[54] CENTRIFUGAL SEPARATOR WITH A REDUCED NUMBER OF FLUIDIZED RECESSES

[76] Inventor: Benjamin Knelson, 20321-86$^{TH}$ Avenue, Langley, British Columbia, Canada, V3A 6Y3

[21] Appl. No.: 08/925,661

[22] Filed: Sep. 9, 1997

Related U.S. Application Data

[63] Continuation-in-part of application No. 08/762,661, Dec. 9, 1996, abandoned.

[51] Int. Cl.$^{6}$ ..... B04B 11/00

[52] U.S. Cl. ..... 494/29; 494/80

[58] Field of Search ..... 494/23, 27–30, 494/43, 45, 63, 65, 80; 210/380.1

[56] References Cited

U.S. PATENT DOCUMENTS

| | | | |
|---|---|---|---|
| 1,473,421 | 11/1923 | Eccleston | 494/29 |
| 1,557,672 | 10/1925 | Doerner | 494/29 X |
| 1,594,501 | 8/1926 | Eccleston | 494/29 |
| 1,718,547 | 6/1929 | Eccleston | 494/29 |
| 4,361,480 | 11/1982 | Corbus . | |
| 4,608,040 | 8/1986 | Knelson | 494/27 |
| 4,776,833 | 10/1988 | Knelson | 494/27 |
| 4,846,781 | 7/1989 | Knelson | 494/27 |
| 5,222,933 | 6/1993 | Knelson et al. | 494/27 |
| 5,338,284 | 8/1994 | Knelson | 494/29 |
| 5,586,965 | 12/1996 | Knelson | 494/29 |
| 5,601,523 | 2/1997 | Knelson | 494/29 |
| 5,601,524 | 2/1997 | Knelson | 494/29 |
| 5,728,039 | 3/1998 | Knelson | 494/29 |

FOREIGN PATENT DOCUMENTS

| | | | |
|---|---|---|---|
| 22055/35 | 4/1936 | Australia | 494/27 |
| 2133722 | 8/1984 | United Kingdom . | |
| WO 96 37307 A | 11/1996 | WIPO . | |

*Primary Examiner*—Charles E. Cooley

*Attorney, Agent, or Firm*—Adrian D. Battison; Murray E. Thrift

[57] ABSTRACT

A centrifuge concentrator bowl of the type having a plurality of fluidized recesses at axially spaced positions along the peripheral wall of the bowl is modified by providing an increase in width of the area between each fluidized recess and the next. In the area between the fluidized recesses is provided a shallower recess which is non-fluidized which provides some collection of materials. The bowl is of a frusto-conical shape so that the open mouth is larger than the base and a restricting ring is attached at the open mouth to define and inner edge of a diameter less than that of the uppermost recess and approximating that of a recess lower in the bowl. The uppermost recess is a fluidized recess and at least one of the lowermost recesses are non-fluidized.

20 Claims, 3 Drawing Sheets

28
18

17
15
13
50
51
30A
40A
30B
40B
30C
40C
30D
40D
30E
30F
12
25
19
20
11A
21
21A
22
26
10
11
23
27
16
24

CENTRIFUGAL SEPARATOR WITH A REDUCED NUMBER OF FLUIDIZED RECESSES

This invention is a Continuation-in-Part application of U.S. application Ser. No: 08/762,661, filed Dec. 9th, 1996 and now abandoned.

This invention relates to a centrifugal separator of the type having a plurality of annular recesses on a peripheral wall of a rotatable bowl in which the number of fluidized annular recesses is reduced.

In U.S. Pat. Nos. 4,608,040, 4,776,833, 5,222,933 and 5,338,284 the present applicant discloses a number of different arrangements of centrifugal separator of the type including a rotatable bowl having a peripheral wall of generally frusto conical shape on which is provided a plurality of axially spaced, annular recesses. The particulate material to be separated is fed in slurry form through a feed duct to a position at or adjacent a base of the bowl so that the feed materials pass over the peripheral wall with heavier particulate materials collecting in the annular recesses while lighter particulate materials escape from the bowl through the open mouth. The annular recesses are fluidized by the injection of fluidizing water through holes in the peripheral wall at the respective recesses thus acting to fluidize the collecting material within the recesses.

One feature of this type of machine is a necessity for the supply of the additional water for providing the fluidizing action within the recesses. In some cases it is desirable to provide a reduction in the quantity of fluidizing water necessary for running the machine.

A further arrangement is therefore disclosed in U.S. Pat. No. 5,586,965, issued Dec. 24th, 1996 of the present inventor in which the number of recesses is reduced and a frusto-conical lead-in section of the bowl is provided which is free from the fluidized recesses so that the feed material is deposited onto the lead-in section and flows over that lead-in section prior to reaching the first annular recess.

In prior U.S. application Ser. No. 08/1494,287 filed Jun. 23, 1995 and is now abandoned is disclosed an improvement in which the arrangement and number of fluid injection openings in the recesses is modified so as to optimize the fluidization and thus reduce the total quantity of fluidizing water.

SUMMARY OF THE INVENTION

It is one object of the present invention to provide an improved centrifugal separator of the above general type in which the number of fluidized recesses is reduced relative to the conventional arrangement.

According to a first aspect of the invention, therefore, there is provided an apparatus for separating intermixed particulate materials of different specific gravity in a slurry comprising:

a centrifuge bowl having a base and a peripheral wall surrounding an axis passing through the base and generally upstanding from the base to an open mouth;

means mounting the bowl for rotation about the axis;

feed means for feeding the intermixed particulate materials in the slurry into the bowl so that during rotation of the bowl the intermixed particulate materials flow over the peripheral wall for collection of heavier particulate materials on the peripheral wall and for discharge of the lighter particulate materials in the slurry from the open mouth;

first guide means for collecting the lighter particulate materials in the slurry discharged from the open mouth;

a plurality of annular fluidized recesses on the peripheral wall at axially spaced positions over which the materials pass so that the heavier particulate materials collect in the recesses;

the annular fluidized recesses each including fluidizing means therein for fluidizing said heavier particulate materials therein, said fluidizing means comprising a plurality of openings into said recess and fluid injection means for injecting fluid through the openings;

second guide means for collecting the heavier particulate materials from said annular fluidized recesses;

the peripheral wall increasing in diameter from the base to the open mouth such that each recess closer to the open mouth has a diameter greater than one closer to the base and such that an uppermost recess has a largest diameter;

and an annular restricting member provided on the bowl at or adjacent the open mouth and extending from the peripheral wall to an inner edge of the restricting member spaced inwardly toward the axis for causing the lighter material and the slurry to escape from the open mouth at a position spaced inwardly toward the axis relative to the uppermost recess.

Preferably the annular restricting member comprises an imperforate ring.

Preferably the inner edge lies on an imaginary cylinder which intersects with the peripheral wall at a position thereon at or below a fluidized recess which is the second from the open mouth.

Preferably there is provided a plurality of non-fluidized recesses, the non-fluidized recesses being free from fluid injection.

Preferably the non-fluidized recesses have a depth less than that of the fluidized recesses.

Preferably between at least some of the fluidized recesses and a next adjacent fluidized recess is provided one of the non-fluidized recesses.

Preferably the fluidized recesses and the non-fluidized recesses are arranged substantially alternately.

Preferably a recess closest to the open mouth is a fluidized recess.

Preferably a recess closest to the base is a non-fluidized recess.

Preferably a plurality of recesses closest to the base are non-fluidized recesses.

According to a second aspect of the invention there is provided an apparatus for separating intermixed particulate materials of different specific gravity in a slurry comprising:

a centrifuge bowl having a base and a peripheral wall surrounding an axis passing through the base and generally upstanding from the base to an open mouth;

means mounting the bowl for rotation about the axis;

feed means for feeding the intermixed particulate materials in the slurry into the bowl so that during rotation of the bowl the intermixed particulate materials flow over the peripheral wall for collection of heavier particulate materials on the peripheral wall and for discharge of the lighter particulate materials in the slurry from the open mouth;

first guide means for collecting the particulate materials in the slurry discharged from the open mouth;

a plurality of annular fluidized recesses on the peripheral wall at axially spaced positions over which the materials pass so that the heavier particulate materials collect in the fluidized recesses;

the annular fluidized recesses each including fluidizing means therein for fluidizing said heavier particulate materials therein, said fluidizing means comprising a plurality of openings into said recess and fluid injection means for injecting fluid through the openings;

second guide means for collecting the heavier particulate materials from said annular fluidized recesses;

and a plurality of non-fluidized recesses, the non-fluidized recesses being free from fluid injection.

Preferable the non-fluidized recesses are of a depth less than that of the fluidized recesses.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
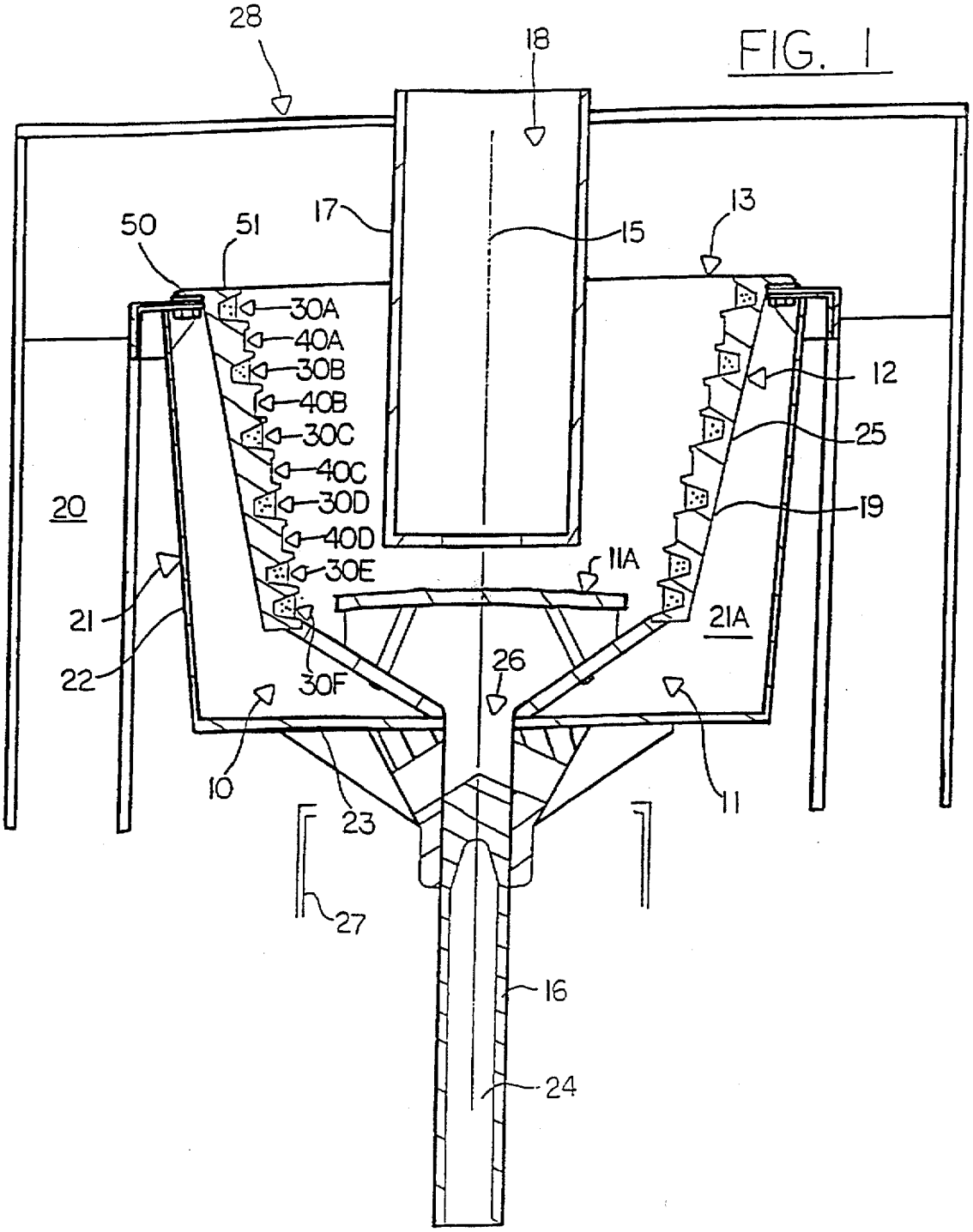
FIG. 1 is vertical cross-sectional view through a centrifugal separator of the type shown in U.S. Pat. No. 5,222,933 to the present inventor which is modified to reduce the number of fluidized recesses.

The general arrangement of the centrifugal separator shown in FIG. 1 is taken from the above U.S. Pat. No. 5,222,933 of the present inventor and therefore will described only briefly in regard to the points of importance. The disclosure of the above patents of the present inventor are incorporated here in by reference for further details which may be necessary for a full understanding.

The apparatus therefore comprising a bowl generally indicated at 10 having a base generally indicated at 11 and a peripheral wall 12 standing upwardly from the base to an open mouth 13. The bowl can rotate around an axis 15 on a support shaft 16. A feed duct 17 carries feed materials 18 through the open mouth to a position adjacent to the base so the feed materials can be deposited onto the base 11 and can move therefrom onto the peripheral wall 12 for separation of heavier materials into a plurality of recesses 19 on the peripheral wall so that the recesses are annular and are axially spaced. The peripheral wall is frusto-conical so that the diameter of the recesses increases from a first recess at the base to a last recess at the open mouth.

Material exiting from the open mouth is collected by a first collection guide 20 for discharge.

Around the bowl 10 is provided a jacket 21 having a peripheral wall 22 and a base 23 both of which are connected to the respective elements of the bowl so as to form a compartment fed with fluidizing water from a central duct 24 of the shaft 16 through connecting ducts (not shown). The compartment therefore between the outside of the bowl and the inside of the jacket receives fluidizing water under pressure which is communicated through openings 25 into the recesses for fluidizing the material collecting in the recesses.

The separation and collection process is a batch process so that the heavier material collected in the recesses or subsequent wash down and collection.

The collected materials when washed down to the base pass through a discharge opening 26 into a second collection system 27 for collecting the concentrate.

The feed duct 17 comprises a cylindrical tube carried on a cover 28 forming a part of the guide system 20. Thus the tube forming the feed duct is in fixed position and remains stationary as the bowl rotates around the axis 15.

The apparatus described above is substantially as shown in the prior patent and is modified in accordance with the present invention by the blocking of a number of the recesses so that the amount of fluidizing water required is reduced.

In the arrangement of the present invention a first series of the recesses 19 as indicated at 30A, B, C, D, E and F which are of the conventional nature previously described particularly in U.S. Pat. Nos. 4,776,833 and 4,608,040 of the present inventor.

A second series of recesses indicated at 40A, B, C, and D is modified relative to the previously described recess arrangement so that the recesses are significantly reduced in depth and are free from connection to the chamber defined by the jacket 21.

It will be noted in FIG. 1 that the recesses 30 and the recesses 40 are arranged alternately so that the uppermost one of the recesses is of the conventional type indicated at 30A, the second of the recesses is of the shallower type indicated at 40A et cetera through to the lowermost two recesses 30E and 30F which are both of the conventional type.

Figure 2:
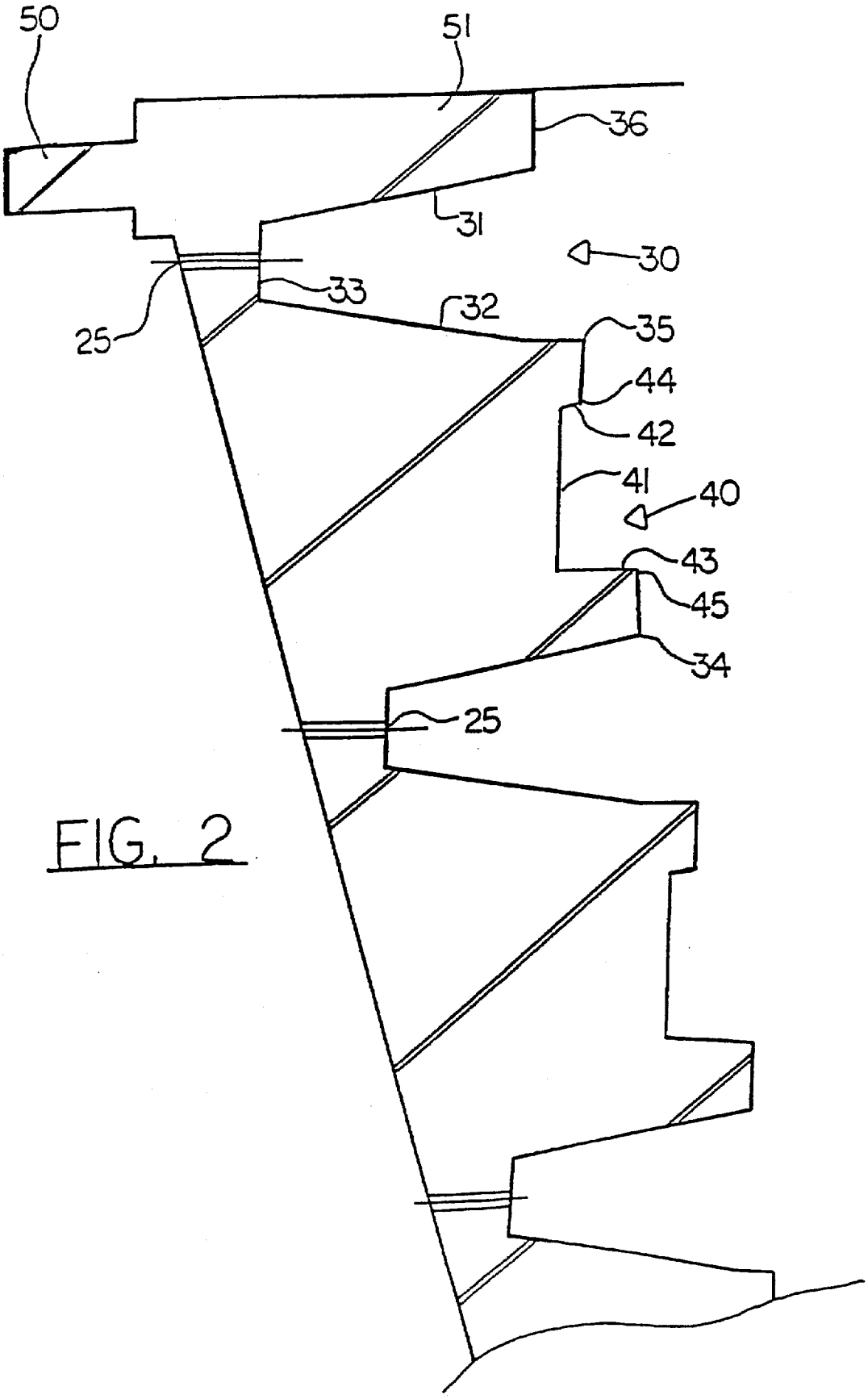
FIG. 2 is a cross-sectional view through one half of a bowl only for use in the apparatus of FIG. 1.

A further example of a bowl of the present invention is shown in FIG. 2 on an enlarged scale so that the construction of the recesses 30 and 40 can be seen in more detail. In the example shown in FIG. 2, the bowl is of a reduced size so that they are only three of the recesses 30 and only two of the recesses 40. It will however be appreciated that the size of the bowl can be varied in accordance with requirements so that the number of recesses is determined in effect by the height of the bowl and a diameter of the recesses is determined by the diameter of the bowl.

Also in FIG. 2 the example shown is of the type which does not include the central opening 26 but includes an opening offset to one side (not shown) which allows the discharge of the material after collection.

In addition the attachment of the bowl to the surrounding jacket is again not shown but it will be appreciated that the outside flange 50 mounted at the outer periphery of the upper part 51 of the bowl allows the bowl to be attached to the jacket to define the injection water receptacle for passage of injection water through the openings 25 into the recesses 30.

As described in the previous patents, the bowl is formed from a suitable elastomeric material which is molded to define the recesses 30 and 40. The elastomeric material can be supported by a metal shell as shown in FIG. 1 or can be unsupported in the use of a relatively small bowl of the type shown in FIG. 2.

The recesses 30 are molded into the resilient material so as to define a generally V shape of the recess with side walls 31 and 32 converging inwardly and outwardly to a flat outer base 33. The side walls define innermost edges 34 and 35 respectively. The uppermost portion 51 of the bowl defines a flat inner surface 36 between the innermost edge 34 of the upper side wall 31 and the mouth of the bowl. The openings 25 communicate with the base 33 substantially at a mid point across the base with the openings being spaced around the base. The base is narrower than the width between the edges 34 and 35. The recesses have a depth between the inner edges 34 and the base 33 which is generally greater than the width of the recess at the mouth of the recess.

The recesses 40 have a base 41 and side walls 42 and 43, the side walls each having an innermost edge 44 and 45 respectively. The wall portion between the inner edge 35 and the inner edge 44 is straight and parallel to the axis of the bowl so as to form an annular band. The inner edges 34, 35 and 45 etc. lie generally on a frusto conical surface including the upper most edge of the bowl at the top of the wall 36 and this forms generally the inner surface of the bowl from which the recesses are recessed outwardly of the axis of the bowl.

The side walls 42 and 43 are parallel and lie in radial planes of the axis. The base 41 is at right angles to the side walls. The depth of the recess 40 as defined by the distance from the inner edges 44 and 45 to the base 41 is very much less than the depth of the recess 30. The recess 40 is not in any way connected with the outside surface of the bowl so that there is no communication of fluidizing liquid to the interior of the recess 40.

The material flowing over the periphery of the bowl thus generally passes over the inner surface of the bowl defined by the edges of the recesses and provides a separation action at the interface between the material in the recesses and the material passing over the peripheral surface.

It will be noted that the width from the innermost edge 35 of the lower side wall 32 to the innermost edge 34 of the side wall 31 of the next adjacent recess is greater than the width of the recesses between the edges 34 and 35. This width is necessarily greater than the width of the recess itself since the recess 40 is substantially the same width as the recess 30 and there is provided the wall portions between those recesses as previously described.

The depth of the recess 40 is just sufficient to allow collection of some material in the recess so that the surface defines between the innermost edge 45 and the innermost edge 35 is defined in effect by the collected materials lying on the conical surface which acts as the separation surface for the materials flowing over the conical surface of the bowl.

In essence the present arrangement using the shallower recesses 40 and replacement for some of the recesses 30 allows the system to use approximately 40% less water for fluidizing. This reduction in fluidizing water has a significant improvement in the operation of the machine and overcomes some problems in the processing of the slurry.

The arrangement of the present invention allows the material to be fluidized in every second ring, that is the alternate rings 30 and this fluidization in the alternate rings allows the material to pass from one fluidizing recess to the next fluidizing recess without allowing the material to dry (squeeze the water out) in a short space between the fluidizing recesses.

At the same time the small recess 40 will allow some material to be retained on the face of each recess area and this now sets up a textured surface defined by the inside surface of the collected material where fine gold particles will have the ability to be trapped in the natural interstices created between the particles.

The reduction in depth of the recesses 40 will also create a small amount of concentrate to be treated in secondary treatment. In addition, if the same total amount of materials to be collected is contained within the smaller amount of concentrate then the concentrate is increased in grade providing a further bonus.

The modification does not decrease the ability of the bowl to handle large volumes of throughput. Other proposals for reducing the number of recesses sometimes provides the problem that the material can dry on the unfluidized walls and as soon as the material dries it tends to collect thus interfering with the proper operation of the bowl. The replacement of the fluidizing recesses at the alternate positions by the recesses 40 allows the material to properly flow through the bowl without the drying effect of the material on the bowl causing loading or imbalance.

Figure 3:
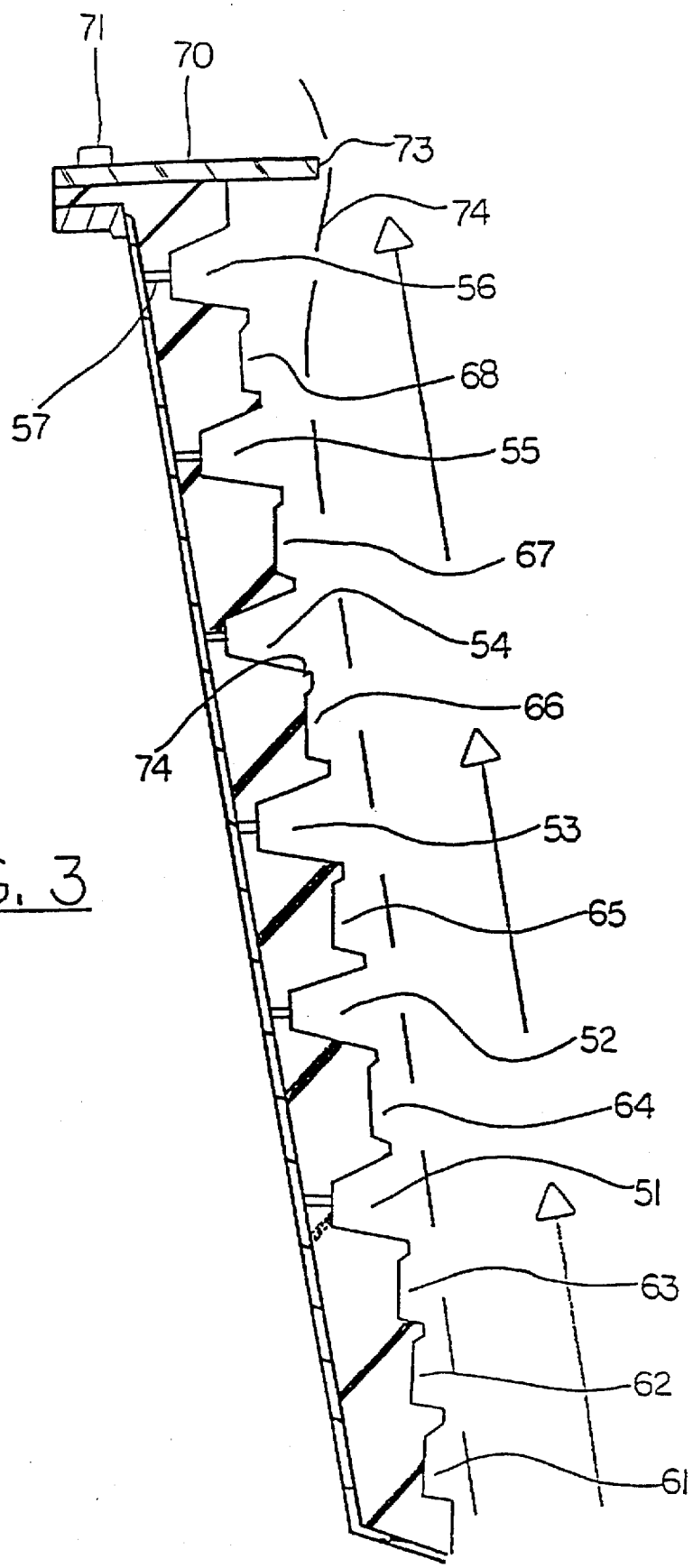
FIG. 3 is a cross-sectional view through one half of an alternative bowl only for use in the apparatus of FIG. 1.

Turning now to FIG. 3 there is shown an alternative bowl construction for use in the apparatus of FIG. 1. The bowl is of the construction substantially as previously described including a plurality of fluidized recesses 51 through 56 and a plurality of non-fluidized recesses 61 through 68. Each of the fluidized recesses has an opening 57 allowing injection of fluid into the recesses for fluidizing the materials as previously described.

In this embodiment the arrangement is modified in that the bottom three recesses are all of the non-fluidized type. The top recess is of the fluidized type. In between these recesses, the remaining recesses alternate between fluidized and non-fluidized types.

The bottom three recesses are arranged so that the lowermost recess is slightly deeper than the second recess 62 and the third recess 63. Thus in one example the lowermost recess 61 is ½ in depth, the second recess 62 is ¼ inch in depth and the remaining recess is of ⅛ inch in depth.

The bowl of FIG. 3 is further modified by the addition of a restricting member 70 in the form of annular imperforate ring attached to the open mouth of the bowl by bolts 71 which clamp an outer part of the ring to the bowl beyond the open mouth with an inner part of the ring projecting inwardly from the mouth to an inner edge 73 of the ring which is spaced inwardly from the peripheral wall at the uppermost recess. We noted that each of the recesses is of course defined by inwardly projecting ribs and the ribs project inwardly to a height which is substantially equal throughout each of the recesses so that as the peripheral wall increases in diameter so the diameter of each recess increases.

The inner edge 73 is circular in plan thus lying on an imaginary cylinder 74 surrounding the axis 75 of the bowl. The cylinder 74 intersects the peripheral wall at the rib 76 which is at one of the recesses spaced downwardly from the uppermost recess and in the embodiment shown is the lower rib of the sixth recess from the top which is recess 66. The imaginary cylinder is thus spaced inwardly from the fluidized recesses 54, 55 and 56.

In operation, the bowl of FIG. 3 allows a significant reduction in the quantity of water while preventing or significantly reducing escape of water outwardly from the bowl through the injection openings 57 which could otherwise carry fine gold or heavier particles through into the jacket where they are lost.

This improvement is achieved by the following processing of the materials.

The provision of the non-fluidized recesses significantly reduces the number of fluidized recesses relative to a conventional bowl in which all of the recesses are fluidized so that the amount of fluid necessary to maintain the fluidized recesses fluidized is significantly reduced.

The recesses at the base of the bowl are all non-fluidized recesses. These recesses are aggressively impacted by the entering materials so there is a significant tendency for those recesses to be scoured or washed. The provision of the shallower non-fluidized recesses at this point significantly reduces this effect.

The shallow recesses do not themselves act to collect significant quantities of the heavier materials. However the shallow recesses do collect some particulate materials and thus define a layer of the particulate materials on the inside surface of the bowl. Additional particulate materials flowing over the surface of the bowl impact upon the particles already in place thus acting as a frictional surface to slow those particles closest to the wall which are the heavier particles and allow them to enter into the next fluidized recess. While the number of fluidized or collecting recesses is therefore reduced, the overall collection efficiency is not significantly reduced and may be enhanced due to the effect of the intervening strips or bands of particulate material which improve the separation when the material reaches the collecting or fluidized recess.

The restricting member at the open mouth closes the material to take up a path indicated at the dash line 80 in which the material is thus spaced inwardly from the recesses above the recess 66. In this way material collects in the zone outwardly of the line of material 80. Additional collection occurs in this zone due to the fluidization in the recesses 54, 55 and 56.

As the bowl is frusto-conical, there tends to be a higher injection pressure at the upper recesses than at the lower recesses. Thus in a conventional bowl the significant in diameter between the lowermost recess and the uppermost recess causes a significant increase in injection pressure at the uppermost recess. In the event that insufficient water is supplied, there is a tendency for water and fine particles to escape from the recesses at the base so as to feed the increase in water being injected in the upper recesses. Any such particles entering into the jacket are of course lost from collection. Conventionally the jacket includes ejection openings which allow any particulates entering the jacket to escape so that the jacket does not become clogged. Such particulates enter into the slurry with the escaping material and thus are lost.

In the present invention, therefore, the provision of the three recesses at the base which are non-fluidized reduced the differential in pressure since the differential is now obtained by comparing the pressure at recess 51 with the preset pressure at recess 56. Yet further the addition of the restriction member 70 tends to decrease the excess pressure at the recess 56 so that it is substantially equal to the excess pressure at the recess 54. The differential therefore in pressure is obtained by comparing the pressure at recess 51 with that of recess 53 and this differential is significantly reduced since the difference in diameter is significantly reduced. This bowl therefore has a reduced tendency for fluid and fine particles to escape from the recess 51.

In a situation therefore where there is insufficient water supply available to provide the required amount of fluidizing water for the bowl the provision of the reduced number of fluidizing recesses and the addition of the restriction member allows the bowl to operate without significantly reducing the collection of the concentrate.

I claim:

1. An apparatus for separating intermixed particulate materials of different specific gravity in a slurry comprising:

a centrifuge bowl having a base and a peripheral wall surrounding an axis passing through the base and generally upstanding from the base to an open mouth;

means mounting the bowl for rotation about the axis;

a feed duct for feeding the intermixed particulate materials in the slurry into the bowl so that during rotation of the bowl the intermixed particulate materials flow over the peripheral wall for collection of heavier particulate materials on the peripheral wall and for discharge of the lighter particulate materials in the slurry from the open mouth;

a launder for collecting the lighter particulate materials in the slurry discharged from the open mouth;

a plurality of annular fluidized recesses on the peripheral wall at axially spaced positions over which the materials pass so that the heavier particulate materials collect in the recesses;

the annular fluidized recesses each including fluidizing means therein for fluidizing said heavier particulate materials therein, said fluidizing means for each recess comprising a plurality of openings into the respective recess and fluid injection means for injecting fluid through the openings;

the peripheral wall increasing in diameter from the base to the open mouth such that each recess closer to the open mouth has a diameter greater than one closer to the base and such that an uppermost recess has a largest diameter;

each annular fluidized recess having a base adjacent the peripheral wall, an upper side wall extending generally inwardly from the base toward the axis and terminating at an inner lip of the upper side wall and a lower side wall extending generally inwardly from the base toward the axis and terminating at an inner lip of the lower side wall;

and an imperforate annular restricting ring provided on the bowl at or adjacent the open mouth and extending from the peripheral wall to an inner edge of the restricting ring spaced inwardly toward the axis for causing the lighter material and the slurry to escape from the open mouth at a position spaced inwardly toward the axis relative to the uppermost recess;

the inner edge of the ring having a diameter less than the diameter of the inner lip of the upper side wall of that one of said fluidized recesses which is the second from the open mouth.

2. The apparatus according to claim 1 wherein there is provided a plurality of non-fluidized recesses, the non-fluidized recesses being free from fluid injection openings.

3. The apparatus according to claim 2 wherein the non-fluidized recesses each have a depth less than that of the fluidized recesses.

4. The apparatus according to claim 2 wherein between at least one of the fluidized recesses and a fluidized recess which is next adjacent to said one fluidized recess is provided one of the non-fluidized recesses.

5. The apparatus according to claim 4 wherein at least some of the fluidized recesses and at least some of the non-fluidized recesses are arranged alternately.

6. The apparatus according to claim 2 wherein that one of said fluidized and non-fluidized recesses which is closest to the open mouth is a fluidized recess.

7. The apparatus according to claim 2 wherein that one of said fluidized and non-fluidized recesses which is closest to the base is a non-fluidized recess.

8. The apparatus according to claim 2 wherein a plurality of said fluidized and non-fluidized recesses which are closest to the base are non-fluidized recesses.

9. An apparatus for separating intermixed particulate materials of different specific gravity in a slurry comprising:

a centrifuge bowl having a base and a peripheral wall surrounding an axis passing through the base and generally upstanding from the base to an open mouth;

means mounting the bowl for rotation about the axis;

a feed duct for feeding the intermixed particulate materials in the slurry into the bowl so that during rotation of the bowl the intermixed particulate materials flow over the peripheral wall for collection of heavier particulate materials on the peripheral wall and for discharge of the lighter particulate materials in the slurry from the open mouth;

a launder for collecting the particulate materials in the slurry discharged from the open mouth;

a plurality of annular fluidized recesses on the peripheral wall at axially spaced positions over which the materials pass so that the heavier particulate materials collect in the fluidized recesses;

the annular fluidized recesses each including fluidizing means therein for fluidizing said heavier particulate materials therein, said fluidizing means for each recess comprising a plurality of openings into the respective recess and fluid injection means for injecting fluid through the openings;

and a plurality of non-fluidized recesses, the non-fluidized recesses being free from fluid injection.

10. The apparatus according to claim 9 wherein between at least one of the fluidized recesses and a fluidized recess which is next adjacent to said one fluidized recess is provided one of the non-fluidized recesses.

11. The apparatus according to claim 9 wherein at least some of the fluidized recesses and at least some of the non-fluidized recesses are arranged substantially alternately.

12. The apparatus according to claim 9 wherein that one of said fluidized and non-fluidized recesses which is closest to the open mouth is a fluidized recess.

13. The apparatus according to claim 9 wherein that one of said fluidized and non-fluidized recesses which is closest to the base is a non-fluidized recess.

14. The apparatus according to claim 9 wherein a plurality of said fluidized and non-fluidized recesses which are closest to the base are non-fluidized recesses.

15.An apparatus for separating intermixed particulate materials of different specific gravity in a slurry comprising:

a centrifuge bowl having a base and a peripheral wall surrounding an axis passing through the base and generally upstanding from the base to an open mouth;

means mounting the bowl for rotation about the axis;

a feed duct for feeding the intermixed particulate materials in the slurry into the bowl so that during rotation of the bowl the intermixed particulate materials flow over the peripheral wall for collection of heavier particulate materials on the peripheral wall and for discharge of the lighter particulate materials in the slurry from the open mouth;

a launder for collecting the particulate materials in the slurry discharged from the open mouth;

a plurality of annular fluidized recesses on the peripheral wall at axially spaced positions over which the materials pass so that the heavier particulate materials collect in the fluidized recesses;

the annular fluidized recesses each including fluidizing means therein for fluidizing said heavier particulate materials therein, said fluidizing means for each recess comprising a plurality of openings into the respective recess and fluid injection means for injecting fluid through the openings;

and a plurality of non-fluidized recesses, the non-fluidized recesses each being free from fluid injection and each having a depth less than that of the fluidized recesses.

16. The apparatus according to claim 15 wherein at least some of the fluidized recesses and at least some of the non-fluidized recesses are arranged substantially alternately.

17. The apparatus according to claim 15 wherein that one of said fluidized and non-fluidized recesses which is closest to the base is a non-fluidized recess.

18. The apparatus according to claim 17 wherein a plurality of said fluidized and non-fluidized recesses which are closest to the base are non-fluidized recesses.

19. An apparatus for separating intermixed particulate materials of different specific gravity in a slurry comprising:

a centrifuge bowl having a base and a peripheral wall surrounding an axis passing through the base and generally upstanding from the base to an open mouth;

means mounting the bowl for rotation about the axis;

a feed duct for feeding the intermixed particulate materials in the slurry into the bowl so that during rotation of the bowl the intermixed particulate materials flow over the peripheral wall for collection of heavier particulate materials on the peripheral wall and for discharge of the lighter particulate materials in the slurry from the open mouth;

a launder for collecting the lighter particulate materials in the slurry discharged from the open mouth;

a plurality of annular non-fluidized recesses on the peripheral wall at axially spaced positions over which the materials pass so that the heavier particulate materials collect in the recesses, each non-fluidized recess being defined by a surface portion of the peripheral wall between two axially spaced land portions of the peripheral wall which surface portion of the peripheral wall is substantially imperforate such that fluidizing liquid is prevented from entering into the recess by passing through the surface portion of the peripheral wall;

and, between the surface portion of at least one non-fluidized recess and the next, an annular fluidizing area on the peripheral wall which contains a plurality of angularly spaced fluidizing openings for adding fluidizing liquid to the materials as they pass over the recesses.

20. An apparatus for separating intermixed particulate materials of different specific gravity in a slurry comprising:

a centrifuge bowl having a base and a peripheral wall surrounding an axis passing through the base and generally upstanding from the base to an open mouth;

means mounting the bowl for rotation about the axis;

a feed duct for feeding the intermixed particulate materials in the slurry into the bowl so that during rotation of the bowl the intermixed particulate materials flow over the peripheral wall for collection of heavier particulate materials on the peripheral wall and for discharge of the lighter particulate materials in the slurry from the open mouth;

a launder for collecting the lighter particulate materials in the slurry discharged from the open mouth;

a plurality of annular non-fluidized recesses on the peripheral wall at axially spaced positions over which the materials pass so that the heavier particulate materials collect in the recesses, each non-fluidized recess being defined by a surface portion of the peripheral wall between two axially spaced land portions of the peripheral wall which surface portion is substantially imperforate;

and at least one annular fluidizing recess axially spaced from each of the non-fluidizing recesses, the or each fluidizing recess having a plurality of angularly spaced fluidizing openings for injection of fluidizing liquid through the peripheral wall for adding fluidizing liquid to the materials therein.

* * * * *